US008000173B2

(12) United States Patent
Abe

(10) Patent No.: US 8,000,173 B2
(45) Date of Patent: Aug. 16, 2011

(54) TIME CORRECTING APPARATUS AND RADIO CONTROLLED TIMEPIECE

(75) Inventor: Hideo Abe, Tokorozawa (JP)

(73) Assignee: Casio Computer Co., Ltd., Tokyo (JP)

( * ) Notice: Subject to any disclaimer, the term of this patent is extended or adjusted under 35 U.S.C. 154(b) by 339 days.

(21) Appl. No.: 12/400,974

(22) Filed: Mar. 10, 2009

(65) Prior Publication Data

US 2009/0231963 A1 Sep. 17, 2009

(30) Foreign Application Priority Data

Mar. 11, 2008 (JP) ..... 2008-060632

(51) Int. Cl.
*G04C 11/02* (2006.01)

(52) U.S. Cl. ..... 368/47

(58) Field of Classification Search ..... 368/46, 368/47; 342/357.22, 357.39
See application file for complete search history.

(56) References Cited

U.S. PATENT DOCUMENTS 4,117,661 A * 10/1978 Bryant, Jr. ..... 368/47
4,287,597 A * 9/1981 Paynter et al. ..... 455/12.1
4,543,657 A * 9/1985 Wilkinson ..... 375/367
2004/0190378 A1* 9/2004 Farmer ..... 368/47
2006/0067166 A1* 3/2006 Murata et al. ..... 368/47
2007/0230285 A1* 10/2007 Nakagawa ..... 368/47

FOREIGN PATENT DOCUMENTS

JP 2002-214372 A 7/2002

* cited by examiner

*Primary Examiner* — Vit W Miska
(74) *Attorney, Agent, or Firm* — Holtz, Holtz, Goodman & Chick PC

(57) ABSTRACT

In a time correcting apparatus, a signal including time codes is sampled to generate a bit sequence of input TCO data. A prognostic TCO data generating unit 33 generates a bit sequence of prognostic TCO data based on a current time calculated by a time calculating circuit 17. An error number calculating unit 34 compares bits of the input TCO data with bits of the prognostic TCO data to count the number of discrepancy, thereby calculating the number of errors, and shifts bits of the prognostic TCO data to generate new TCO data and compares bits of the new TCO data with bits of the input TCO data to calculate the number of errors. A judging unit 35 judges if the number of errors is valid. When the number of errors is valid, a time correcting unit 36 calculates a time difference of the calculated current time based on the number of shifting bits, as much as which number of shifting bits the prognostic TCO data has been shifted to calculate such valid number of errors.

19 Claims, 8 Drawing Sheets

FIG. 5

| STEPS | THE NUMBER OF ERRORS | |
|---|---|---|
| 0 | 0 | 500 |
| 1 | 240 | |
| 2 | 480 | |
| 3 | 550 | |
| 4 | 620 | |
| 5 | 696 | |
| 6 | 632 | |
| 7 | 568 | |
| 8 | 568 | |
| 9 | 398 | |
| 10 | 228 | 501 |
| 11 | 410 | |
| 12 | 592 | |
| 13 | 664 | |
| 14 | 656 | |
| 15 | 732 | |
| 16 | 668 | |
| 17 | 622 | |
| 18 | 624 | |
| 19 | 456 | |
| 20 | 288 | 502 |
| 21 | 454 | |
| 22 | 610 | |
| 23 | 610 | |
| 24 | 660 | |
| 25 | 720 | |
| 26 | 652 | |
| 27 | 598 | |
| 28 | 598 | |
| 29 | 428 | |
| 30 | 258 | 503 |
| 31 | 428 | |
| 32 | 598 | |
| 33 | 598 | |
| 34 | 652 | |
| 35 | 732 | |
| 36 | 672 | |
| 37 | 628 | |
| 38 | 626 | |
| 39 | 454 | |
| 40 | 282 | 504 |
| 41 | 442 | |
| 42 | 662 | |
| 43 | 592 | |
| 44 | 648 | |

TIME CORRECTING APPARATUS AND RADIO CONTROLLED TIMEPIECE

CROSS REFERENCE TO RELATED APPLICATIONS

The present application is based upon and claims the benefit of priority from the prior Japanese Patent Application No. 2008-60632, filed Mar. 11, 2008, the entire contents of which are incorporated herein by reference.

BACKGROUND OF THE INVENTION

1. Field of the Invention

The present invention relates to a time correcting apparatus using a standard time radio wave to correct a calculated current time and a radio controlled clock or watch provided with the time correcting apparatus.

2. Description of the Related Art

At present, in Japan, Germany, England and Switzerland, such services are provided that transmit a low frequency standard time radio wave(s) carrying time information from a transmitting station(s). In Japan, for instance, a transmitting station in Fukushima Prefecture transmits an amplitude modulated standard time radio wave of 40 kHz, and a transmitting station in Saga Prefecture transmits an amplitude modulated standard time radio wave of 60 kHz.

The standard time radio wave carries time information (TCO: time codes) including data of date: year, month, date, time and minutes, and is transmitted every 60 seconds, which means that a cycle of the time codes is 60 sec.

Clocks and watches (radio controlled clocks and watches) are widely used, which receive the standard time radio wave carrying the time codes, and detect the times codes from the standard time radio wave to correct a time to be displayed thereon. A receiving circuit of the radio controlled timepiece comprises a band pass filter (BPF), demodulating circuit, and processing circuit. The band pass filter receives radio waves from an antenna and detects only a standard time radio wave signal. The demodulating circuit demodulates the amplitude modulated standard time radio wave signal. The processing circuit reads the time codes included in the signal demodulated by the demodulating circuit.

A conventional processing circuit makes synchronization with a rising edge of a time code output signal (TCO signal, time codes) and measures a pulse wide of TCO signal, thereby obtaining a digital value (any one of P, 0, 1) corresponding to the detected pulse width, and obtains time information based on the obtained digital value.

In the conventional processing circuit, a second synchronization process, minute synchronization process, code reading process and matching judgment process are performed during a period from receipt of the standard time radio signal to detection of the time information. When an operation has not been properly performed in each process, the processing circuit has to perform the processes again from the first process. Therefore, noises included in the signal can disturb the operation of the process circuit, resulting in an extremely long time taken by the processing circuit before obtaining the time information.

The second synchronization process detects a marker or a position maker appearing every second in TCO signal. When the second synchronization process is repeatedly performed, a portion can be detected, in which a position maker PO locating at the tail end of frame and a maker M locating at the leading edge of frame continuously appear in the TCO signal. The portion appears every minute in the TCO signal. The position where the marker M appears is the leading position of the frame of TCO signal. An operation of detecting the portion where the position maker PO and the maker M continuously appear in TCO signal is referred to as "minute synchronization". Since the leading edge of frame can be detected in the minute synchronization, an operation of reading codes starts thereafter. After one frame of data has been obtained, the matching judgment process is performed to judge a parity bit included in the data, thereby confirming whether the obtained data is impossible or not, that is, whether or not the obtained data indicates impossible year, month, date, time and minute. The minute synchronization is performed to detect the leading edge of frame. Therefore, the minute synchronization needs a period of 60 seconds to detect such leading edge of frame. Off course, searching for over plural frames of data, the minute synchronization takes more than 60 seconds to detect the leading edge of frame.

JP 2002-214372 A discloses a time adjusting apparatus which receives the standard time electromagnetic wave to detect time data, and stores the time data, and counts a periodical signal generated within the apparatus to obtain internal time data and corrects the internal time data using external data, and adjusts a frequency dividing value of the periodical signal based on a difference between the internal time data and the external time data. The periodical signal generated in the apparatus is corrected to enhance accuracy of the internal time data, whereby an interval of receiving the standard time electromagnetic wave can be made long.

In the technique disclosed in JP 2002-214372 A, the internal periodical signal is optimized, whereby a time can be displayed as precise as possible even when no standard time is received. But the process of receiving the standard time radio wave to obtain the external time data is substantially the same as conventional processes. And the technique still has a disadvantage that when an error should occur in the second synchronization process and/or minute synchronization process, the process has to be performed again from the beginning.

SUMMARY OF THE INVENTION

The present invention has an object to provide a time correcting apparatus and a radio controlled timepiece, which can quickly receiving time information without being affected by errors arising from noises.

According to one aspect of the present invention, there is provided a time correcting apparatus, which comprises a receiving unit for receiving a standard time radio wave to detect a signal including time codes, a data storing unit for scoring data, an input TCO data generating unit for sampling the signal detected by the receiving unit to generate a bit sequence consisting of the certain number of frames and temporarily storing the bit sequence as input TCO data in the data storing unit, a clock generating unit for generating a clock signal, an internal time calculating unit for counting the clock signal generated by the clock generating unit to calculate a current time, a prognostic TCO data generating unit for generating a bit sequence of a prognostic TCO data based on the current time calculated by the internal time calculating unit, wherein the generated prognostic TCO data corresponds to said current time, an error calculating unit for comparing bits of the input TCO data stored in the data storing unit with bits of the prognostic TCO data generated by the prognostic TCO data generating unit to count the number of discrepancies between the bits of the two pieces of TCO data, thereby calculating the number of errors, and for shifting the bits of one of the prognostic TCO data and the input TCO data to generate new TCO data, and comparing bits of the new TCO data with the bits of one of the prognostic TCO data and the input TCO data, whichever has not been shifted, to count the number of discrepancies between the bits of the two pieces of data, thereby calculating the number of errors, a validity judging unit for judging whether the number of errors calculated by the error calculating unit is valid or not, a time difference calculating unit for, when the validity judging unit determines that the number of errors is valid, calculating a time difference of the current time calculated by the internal time calculating unit based on the number of shifting bits, as much as which number of shifting bits one of the prognostic TCO data and the input TCO data has been shifted to calculate said valid number of errors, and a time correcting unit for correcting the current time calculated by the internal time calculating unit based on the time difference calculated by the time difference calculating unit.

According to another aspect of the invention, there is provided a radio controlled timepiece, which comprises a receiving unit for receiving a standard time radio wave to detect a signal including time codes, a data storing unit for storing data, an input TCO data generating unit for sampling the signal detected by the receiving unit to generate a bit sequence consisting of the certain number of frames and temporarily storing the bit sequence as input TCO data in the data storing unit, a clock generating unit for generating a clock signal, an internal time calculating unit for counting the clock signal generated by the clock generating unit to calculate a current time, a prognostic TCO data generating unit for generating a bit sequence of a prognostic TCO data based on the current time calculated by the internal time calculating unit, wherein the generated prognostic TCO data corresponds to said current time, an error calculating unit for comparing bits of the input TCO data stored in the data storing unit with bits of the prognostic TCO data generated by the prognostic TCO data generating unit to count the number of discrepancies between the bits of the two pieces of data, thereby calculating the number of errors, and for shifting the bits of one of the prognostic TCO data and the input TCO data to generate new TCO data, and comparing bits of the new TCO data with the bits of one of the prognostic TCO data and the input TCO data, whichever has not been shifted, to count the number of discrepancies between the bits of the two pieces of data, thereby calculating the number of errors, a validity judging unit for judging whether the number of errors calculated by the error number calculating unit is valid or not, a time difference calculating unit for, when the validity judging unit determines that the number of errors is valid, calculating a time difference of the current time calculated by the internal time calculating unit based on the number of shifting bits, as much as which number of shifting bits one of the prognostic TCO data and the input TCO data has been shifted to calculate said valid number of errors, a time correcting unit for correcting the current time calculated by the internal time calculating unit based on the time difference calculated by the time difference calculating unit, and a time displaying unit for displaying the current time corrected by the correcting unit.

BRIEF DESCRIPTION OF THE DRAWINGS

FIG. 5 is a table in which time differences and corresponding number of errors are given, wherein the time difference indicates a difference between a calculated current time and the standard time.

DETAILED DESCRIPTION OF THE PREFERRED EMBODIMENTS OF THE INVENTION

Embodiments of a radio controlled clock according to the present invention will be described with reference to the accompanying drawings. A time correcting apparatus of the present invention is used in the radio controlled clock or watch, which receives and detects a standard time radio wave signal in the long wave range, thereby obtaining time code data (TCO data) included in the signal, and corrects a time to be displayed using the obtained TCO data.

At present, in Japan, Germany, England, Switzerland such services are provided that transmits standard time radio waves from radio wave transmitting stations. In Japan, for example, two amplitude modulated standard time waves of 40 kHz and 60 kHz are transmitted from transmitting stations in Fukushima and Saga Prefectures, respectively. The standard time radio waves carry TCO data including data of year, month, date, time and minute and is transmitted every 60 minutes.

Figure 1:
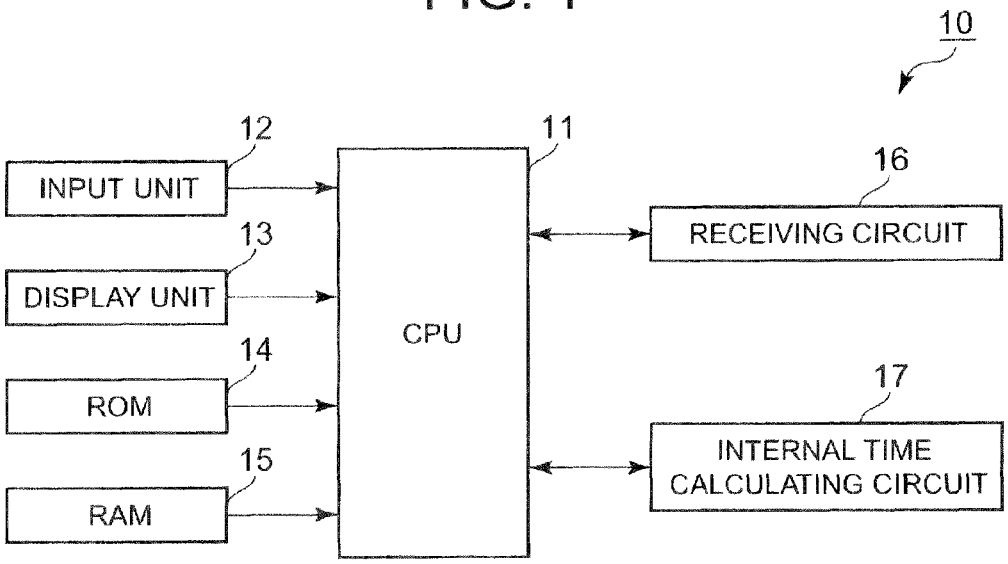
FIG. 1 is a block diagram of a circuit configuration of a radio controlled timepiece according to an embodiment of the present invention.

FIG. 1 is a block diagram illustrating a circuit configuration of the radio controlled timepiece 10 according to the present invention. As shown in FIG. 1, the radio controlled timepiece 10 comprises CPU 11, input unit 12, display unit 13, ROM 14, RAM 15, receiving circuit 16 and an internal time calculating circuit 17.

CPU 11 reads a program stored in ROM 14 at a certain timing or in response to an operation signal sent from the input unit 12 and expands the program on RAM 15 to execute the program, thereby sending instructions and/or data to various units in the radio controlled timepiece 10.

More specifically, CPU 11 performs a time correcting process and time information transferring process. In the time correcting process, CPU 11 controls the receiving circuit 16 to receive the standard time radio wave every certain interval and obtains input TCO data from the standard time radio wave received by the receiving circuit 16, and corrects a current time calculated by the internal time calculating circuit 17 based on the obtained input TCO data. In the time information process, the current time calculated by the internal time calculating circuit 17 is transferred to the display unit 13.

In the present embodiment, the second synchronization and minute synchronization in conventional techniques are not used, as will be described later, but one frame of input TCO data is obtained and the obtained input TCO data is compared with a prognostic TCO data generated based on the current time calculated by the internal time calculating circuit 17, whereby an error is calculated in a time counting operation performed by the internal time calculating circuit 17, and the current time is corrected using the calculated error.

The input unit 12 includes switches for giving instructions to execute various functions of the radio controlled timepiece 10. The input unit 12 sends an operation signal to CPU 11 in response to manipulation of the switch. The display unit 13 has a timepiece face, analog time indicating mechanism controlled by CPU 11, and a liquid crystal display panel, and displays the current time calculated by the internal time calculating circuit 17.

ROM 14 stores a system program, application programs etc for making the radio controlled timepiece 10 work and realizing various functions. RAM 15 is used as a work area of CPU 11 and temporarily stores the program, data read from ROM 14 and data processed by CPU 11.

The receiving circuit 16 has an antenna circuit and detector circuit, and detects a signal including TCO data from the standard time radio wave received by the antenna circuit, and outputs the signal to CPU 11.

The internal time calculating circuit 17 has an oscillator for generating a clock signal, and counts the clock signal to calculate the current time, thereby outputting current time data to CPU 11.

Figure 2:
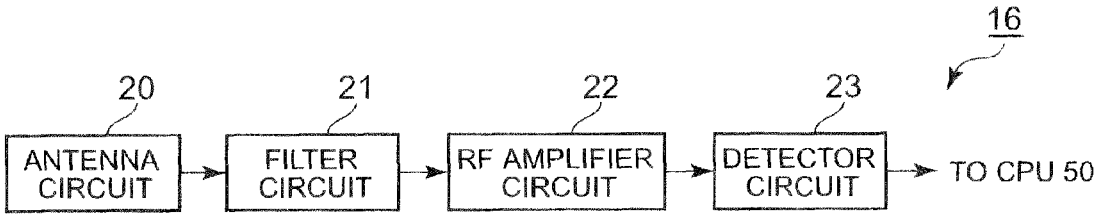
FIG. 2 is a block diagram of a circuit configuration of a receiving circuit in the embodiment of the invention.

FIG. 2 is a block diagram illustrating a circuit configuration of the receiving circuit 16. As shown in FIG. 2, the receiving circuit 16 comprises an antenna circuit 20, filter circuit 21, RF amplifier circuit 22 and a detector circuit 23. The antenna circuit 20 receives the standard time radio wave. The filter circuit 21 removes noises from a signal of the standard time radio wave signal received by the antenna circuit 20. RF amplifier circuit 22 amplifies the received standard time wave signal (high frequency signal). The detector circuit 23 detects and demodulates the standard time wave signal. The signal demodulated by detector circuit 23 includes TCO data and this TCO data is input to CPU 11. CPU 11 A/D converts the received TCO data to obtain the input TCO data, and obtains time information from the input TCO data.

Figure 3:
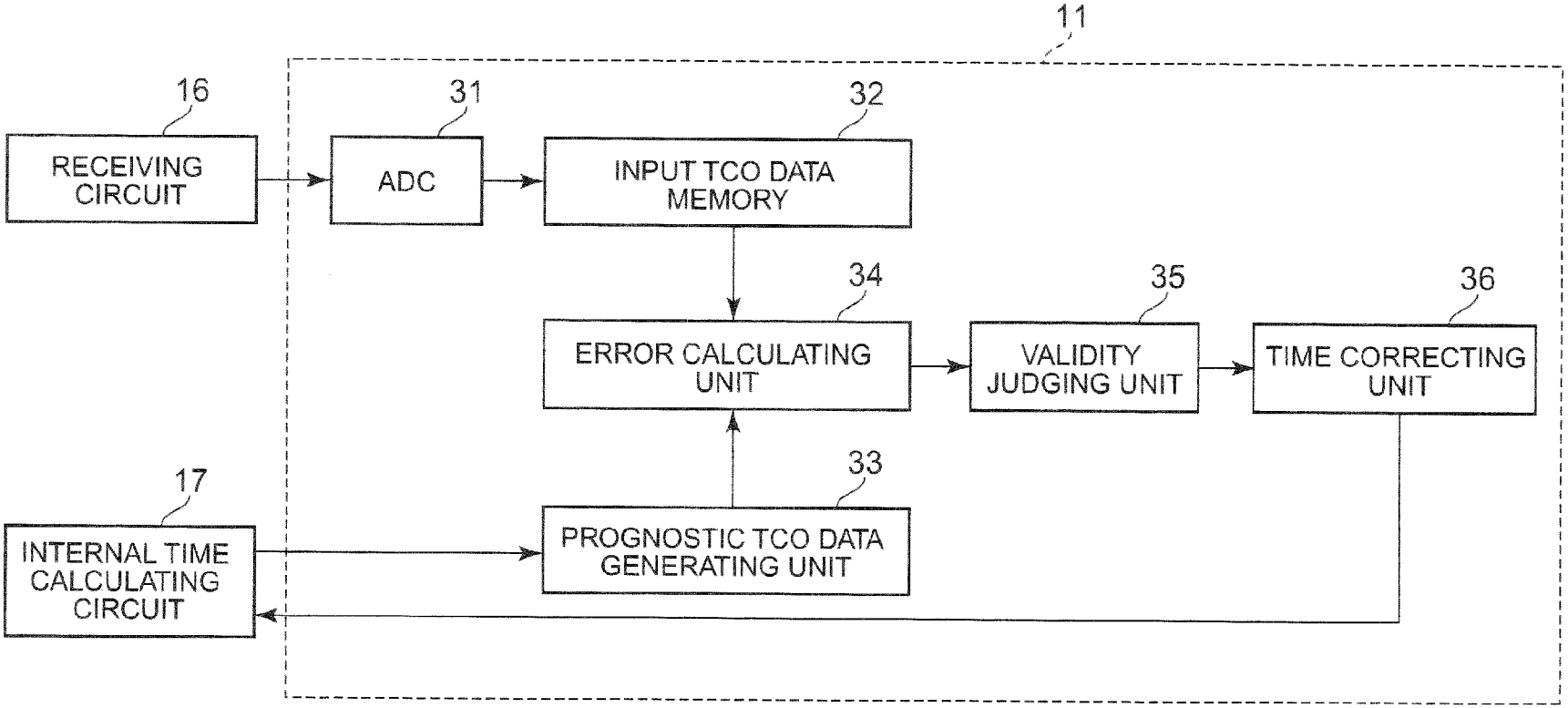
FIG. 3 is a block diagram of a circuit configuration of a portion corresponding to a time correcting apparatus used in the radio controlled clock according to the embodiment of the invention.

FIG. 3 is a block diagram illustrating a circuit configuration of a portion corresponding to a time correcting apparatus used in the radio controlled timepiece according to the embodiment of the present invention. In the present embodiment, the conventional second synchronization and minute synchronization are not performed, but the input TCO data obtained through the receiving unit 16 is compared with the prognostic TCO data generated based on the current time calculated by the internal time calculating circuit 17, whereby the current time is corrected based on the result of the comparison of the input TCO data with the prognostic TCO data.

In the embodiment shown in FIG. 3, the portion corresponding to the time correcting apparatus comprises AD converter (ADC) 31, an input TCO data memory 32, prognostic TCO data generating unit 33, error calculating unit 34, validity judging unit 35 and a time correcting unit 36. The receiving circuit 16 supplies the analog signal including TCO data to AD converter (ADC) 31, and AD converter (ADC) 31 samples the supplied analog signal at a certain sampling period "T" to convert the same signal into digital data (input TCO data). The input TCO data memory 32 stores the input TCO data sent from ADC 31. The prognostic TCO data generating unit 33 generates prognostic TCO data based on the current time data output from the internal time calculating circuit 17. The error calculating unit 34 compares bits of the input TCO data stored in the input TCO data memory 32 with bits of the prognostic TCO data, thereby calculating the number of errors, which indicates a difference between them. The validity judging unit 35 detects the minimum and local minimum numbers of errors and judges validity of the minimum and local minimum numbers of errors. The validity of the number of errors will be described later.

Now, the principle of a time correction by the time correcting apparatus according to the invention will be described.

Figure 4:
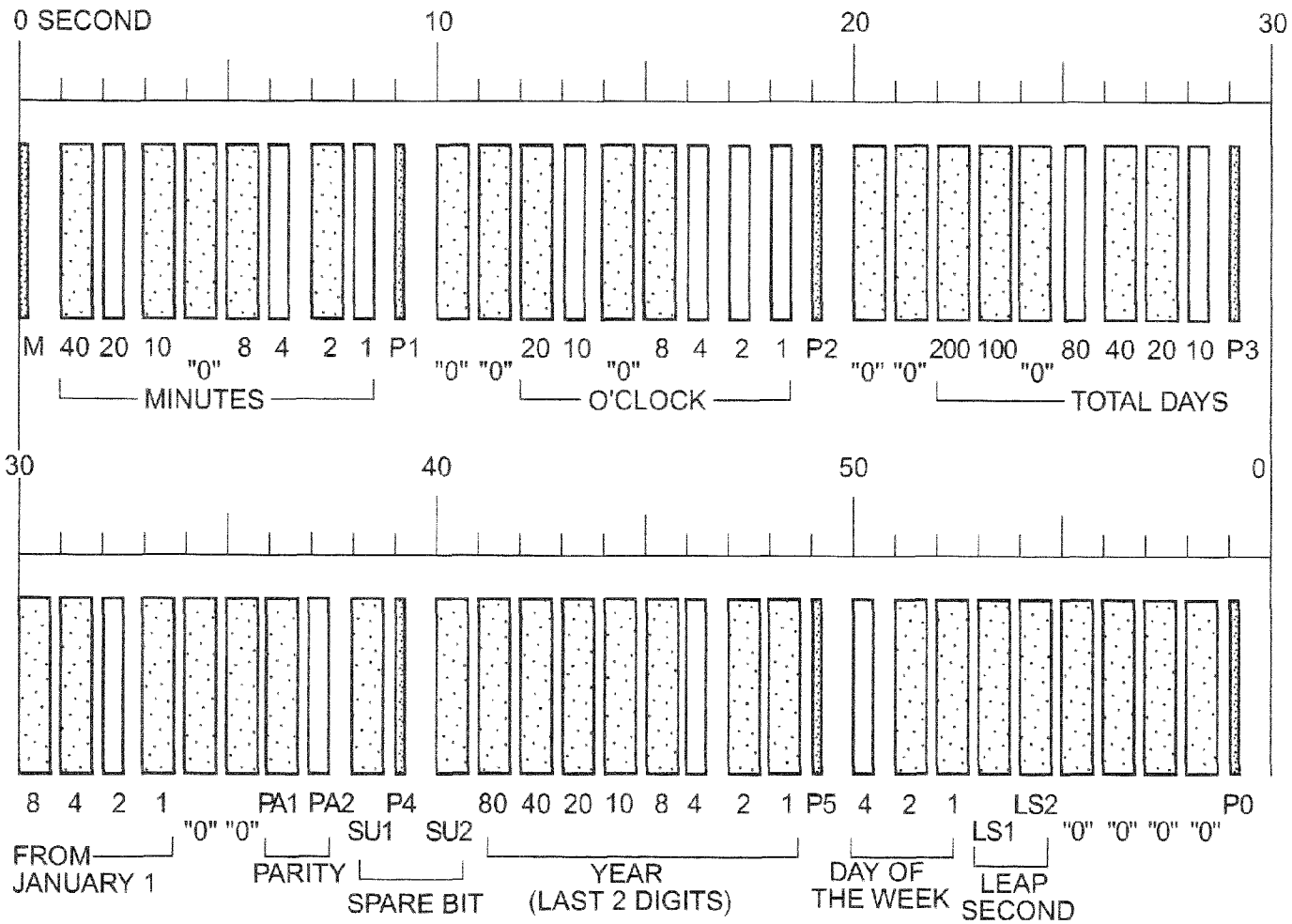
FIG. 4 is a view showing an example of a standard time radio wave signal.

The standard time radio wave is transmitted in an established format as shown in FIG. 4. Therefore, if the correct current time is known, TCO data can be predicted. In the case the current time calculated by the internal time calculating circuit 17 completely coincides with the standard time, when the prognostic TCO data that is generated based on the current time calculated by the internal time calculating circuit 17 and input TCO data that is obtained through the receiving circuit 16 are compared, their bits must completely coincide with each other. For example, when corresponding bits are entered to Exclusive OR circuits (EOR), outputs of every EOF will be "0".

Meanwhile, if there is a difference between the current time calculated by the internal time calculating circuit 17 and the standard time, some EORs output "1". The number of EORs which, output "1", in other words, the number of bits that do not coincide with each other is referred to as the number of errors.

FIG. 5 is a table, in which time differences (steps) between the calculated current times and the standard time are shown together with the numbers of errors corresponding to the time differences, in the case where the calculated current times are different from the standard time. In this example, two pieces of TCO data are shifted from each other by one step of 0.1 sec. to count the number of errors "E". The step takes a value ranging from "0" (0 sec.) to "44" (4.4 sec).

As shown in FIG. 5, if a time difference between two pieces of TCO data is a step "0" ((0 sec.), the number of errors will be 0 in theory (Refer to a reference numeral "500"). Further, it will be understood from the table of FIG. 5 that the number of errors will takes a local minimum value at steps 10 (1 sec.), 20 (2 sec), 30 (3 sec.) and 40 (4 sec.) (Refer to reference numerals 501 to 504).

Although not shown in FIG. 5, the number of errors will take the local minimum value at steps 60, 120 and 180, too. This seems due to that TOC data is a PWM signal having fundamental pulses of a pulse width of 1 sec. and information is transmitted on the basis of one frame of 60 sec.

In the present embodiment are prepared two pieces of data, that is, one is input TCO data obtained through the receiving circuit 16 and other is prognostic TCO data generated based on the current time calculated by the internal time calculating circuit 17. ADC 31 samples a signal obtained from the receiving circuit 16 at a certain sampling period "T", thereby generating a bit sequence of the input TCO data. The generated input TCO data is stored in the input TCO data memory 32.

In a similar manner, the prognostic TCO data generating unit 33 samples the current time calculated by the internal time calculating circuit 17 at a certain sampling period, thereby generating a bit sequence of a prognostic TCO data. The prognostic TCO data is successively shifted in bit as being sequentially processed. The error calculating unit 34 successively compares the input TCO data stored in the input TCO data memory 32 with the prognostic TCO data and specifies the prognostic TCO data showing the minimum number of errors, and further judges the validity of such minimum number of errors.

Figure 6:
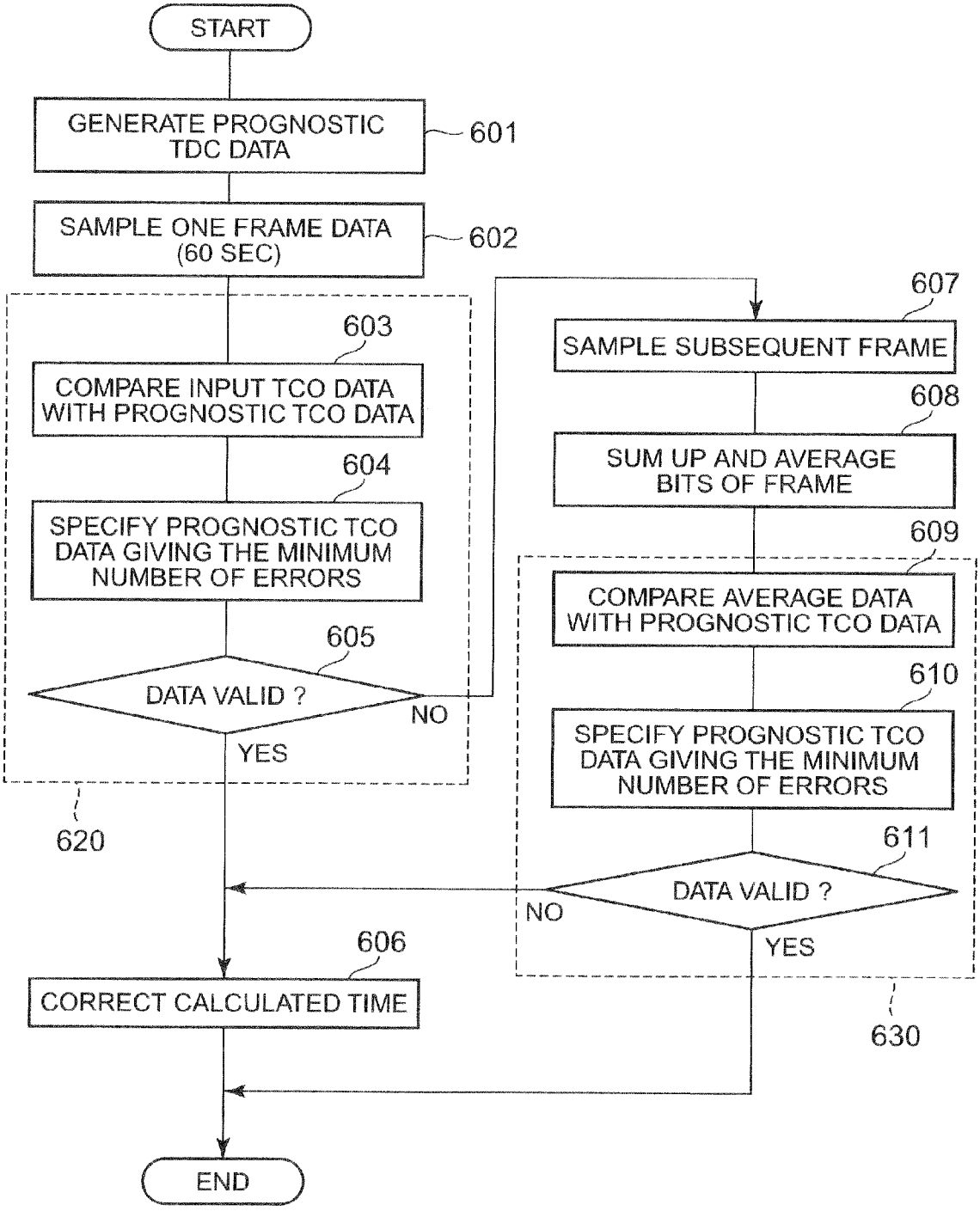
FIG. 6 is a flow chart of a time correcting process in the embodiment of the invention.

FIG. 6 is a flow chart of an example of a time correcting process performed in the present embodiment.

The prognostic TCO data generating unit 33 generates the prognostic TCO data using the current time counted by the internal time calculating circuit 17 at step 601, whereby a bit sequence is generated, in which any one of a bit sequence (high level/low level duty ratio is 2:8) indicating "P", a bit sequence (high level/low level duty ratio is 1:1) indicating "1", and a bit sequence (high level/low level duty ratio is 8:2) indicating "0" is arranged in each second, and further 60×T ("T": sampling period) pieces of such bit sequences are arranged in a predetermined order, as shown in FIG. 4.

The prognostic TCO data has a marker (leading marker) at its leading position, position markers at every position each corresponding to a second, and a position marker at its tail end position.

ADC 31 A/D converts the signal sent, from the receiving circuit 16 and samples one frame of data (data for 60 sec.) at the sampling period "T" and stores the sampled data in the input TCO data memory 32 at step 602. The data (input TCO data) stored in the input TCO data memory 32 is data that corresponds to a period of 60 seconds and is picked up without performing the second synchronization and/or minute synchronization.

Therefore, in the picked up input TCO data, bit sequences corresponding to the position marker appear every second, but the marker not always appears at the leading position of the picked up input TCO data. The input TCO data consists of 60×T pieces of bit sequences each including 60 pieces of bit sequences indicating any one of "P", "1" and "0". The picked up input TCO data not always begins with the leading marker, and in many cases the picked up input TCO data has the leading marker of the input TCO data in its middle position. Since the input TCO data is obtained from the signal received by the receiving circuit 16, noises can be included in the data depending on signal receiving conditions.

The error calculating unit 34 performs a data comparing process at step 620, wherein the input TCO data stored in the input TCO data memory 32 is compared with the prognostic TCO data generated by the prognostic TCO data generating unit 33. In the present embodiment, the error calculating unit 34 compares the input TCO data with the prognostic TCO data with respect to each bit, that is, each bit of both data, is entered to EOR, and the number of EORs which output "1" is counted to calculate the number of errors. The prognostic TCO data generating unit 33 successively shifts bits of the prognostic TCO data, thereby generating new prognostic TCO data, and the error calculating unit 34 compares the input TCO data with the new prognostic TCO data to calculate the number of errors at step 603.

Figure 8A:
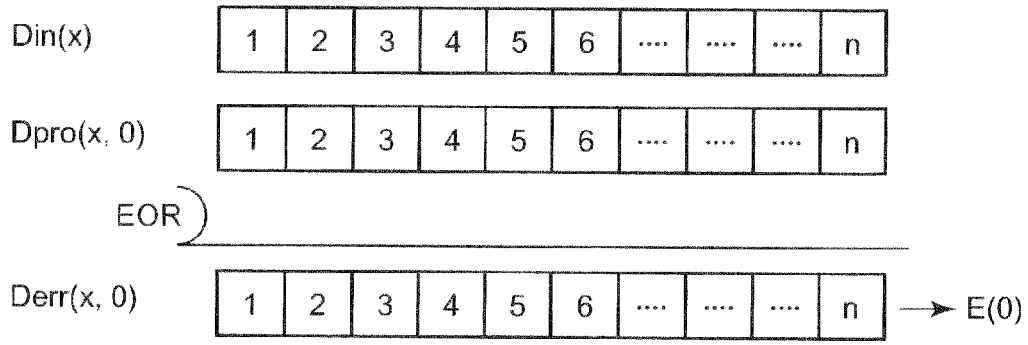
FIGS. 8A, 8B and 8C are views for explaining comparison of the input TCO data with prognostic TCO data and calculation of the number of errors.
Figure 8B:
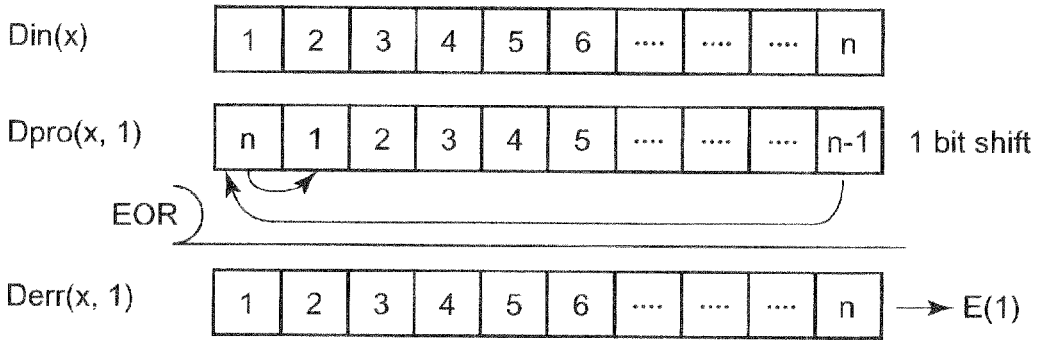
Figure 8C:
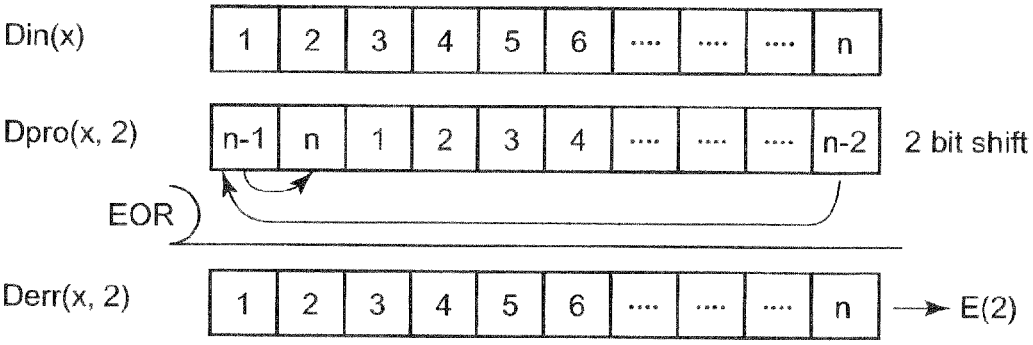

FIGS. 8A, 8B and 8C are views for explaining comparison of the input TCO data with the prognostic TCO data and calculation of the number of errors. In FIGS. 8A, 8B and 8C, bits of the input TCO data are expressed by Din (x), where "x" denotes bits x=1, 2, 3, . . . , n, and "n" corresponds to a bit length of the input TCO data. Bits of the prognostic TCO data are expressed by Dpro (x, k), where "k" denotes the number of shifting bits in the prognostic TCO data.

As shown in FIG. 8A, the number of shifting bits of the prognostic TCO data is "0" at the initial stage. Bits of the input TCO data Din (x) and bits of the prognostic TCO data Dpro (x, 0), where the number of shifting bits is 0 ("k"=0), are entered to EORs, and errors Deff (x, 0) are obtained with respect to all the bits. The error calculating unit 34 calculates the total number of errors ΣDeff (x, 0) with respect to all the bits, thereby obtaining the number of errors E(0).

Then, the prognostic TCO data generating unit 33 shifts the prognostic TCO data by one bit (the number of shifting bits is "1" ("k"=1)), thereby generating new prognostic TCO data as shown in FIG. 8B. Then, bits of the new prognostic TCO data will be given by Dpro (x, 1). The bits of the input TCO data Din (x) and bits of the prognostic TCO data Dpro (x, 1), where the number of shifting bits is 1 ("k"=1), are entered to EORs, and errors Deff (x, 1) are obtained with respect to all the bits. The error calculating unit 34 calculates the total number of errors ΣDeff (x, 1) with respect to all the bits, thereby obtaining the number of errors E (1).

In FIG. 8*c*, the prognostic TCO data generating unit 33 shifts the prognostic TCO data by two bits (the number of shifting bits is "2" ("k"=2)), thereby generating another prognostic TCO data. Then, bits of the prognostic TCO data will be given by Dpro (x, 2). The bits of the input TCO data Din (x) and bits of the prognostic TCO data Dpro (x, 2), where the number of shifting bits is 2 ("k"=2), are entered to EORs, and errors Deff (x, 2) are obtained with respect to all the bits. The error calculating unit 34 calculates the total number of errors ΣDeff (x, 2) with respect to all the bits, thereby obtaining the number of errors E (2).

The above processes are repeatedly performed, and the validity judging unit 35 finds the minimum number of errors E(p) at step 604 and judges whether the minimum number of errors E(p) is valid or not at step 605. The validity judgment is made based on whether or not the minimum number of errors E(p) is small enough compared with other number of errors to the extent that said minimum number of errors E(p) can be recognized valid.

More specifically, for instance, even if the number of errors is a local minimum value, it is determined that such number of errors is not valid when said number of errors is larger than the average value of the numbers of errors, or it is determined that the minimum, number of errors or the local minimum number of errors is valid when said the minimum number of errors or said local minimum number of errors is smaller than "average value−standard deviation" of the numbers of errors.

A general significance revel (for example, 5 percent) in statistics may be used to make the validation judgment.

When it is determined that the minimum number of errors E(p) is valid (YES at step 605), the time correcting unit 36 calculates a time difference or an error $\Delta t$ of the current time at the present moment, based on the prognostic TCO data Dpro(x, p) and input TCO data Din (x) giving said minimum number of errors E(p), and corrects the current time using the error $\Delta t$ (time difference) at step 606.

Figure 9:
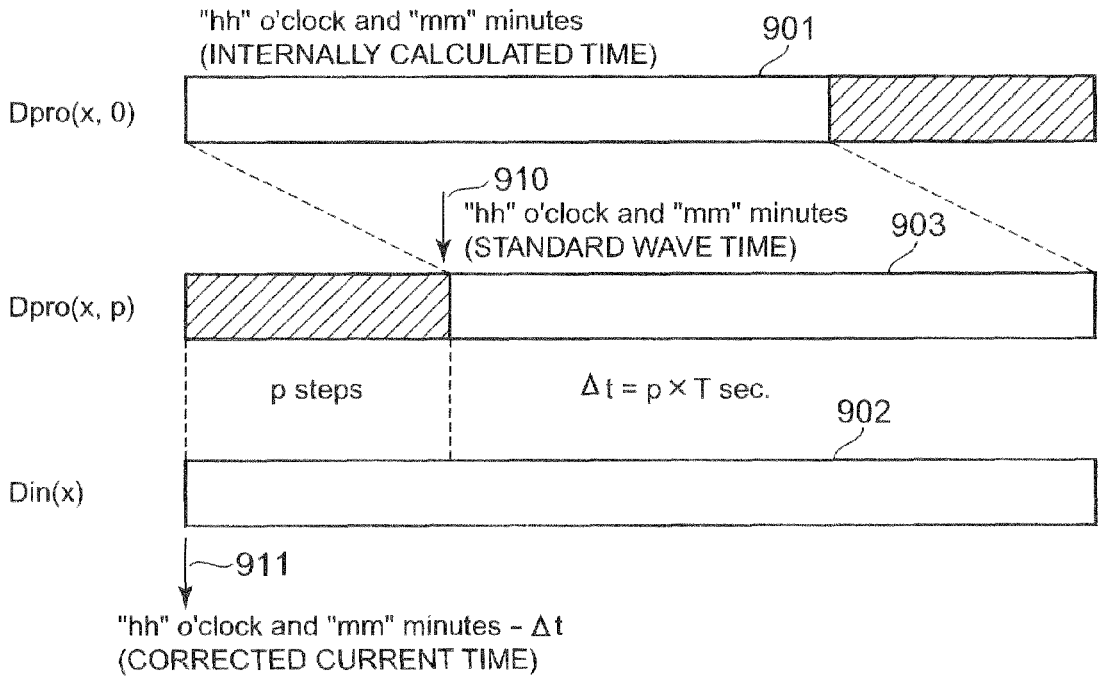
FIG. 9 is a view for explaining an error $\Delta t$ of time in the second embodiment.

FIG. 9 is a view for describing the error $\Delta t$ of time in the present embodiment. As shown in FIG. 9, initially generated prognostic TCO data (Dpro (x, 0), Refer to the reference numeral 901) indicates an internal clock time: "hh" o'clock and "mm" minutes. It is presumed that the number of errors E(p) is minimum and valid in the process of comparing the prognostic TCO data with input TCO data.

A position shifted by "p" steps from the top in the prognostic TCO data (Dpro(x, p), Refer to a reference numeral 903) is considered corresponding to the leading position of data indicating the current time: "hh" o'clock and "mm" minutes measured by GPS (Refer to a reference numeral 910), wherein it is considered that a time corresponds to "p" steps is equivalent to the error $\Delta t$ (time difference) of the internal clock time.

In the present embodiment, since one step of shifting bits corresponds to 1/T sec. ("T": sampling period), the error $\Delta t$ will be p×T sec. The time (internal clock time) when prognostic TCO data is generated will be given by ("hh" o'clock and "mm" minutes $\Delta t$) (Refer to a reference numeral 911). In the above manner, the time correcting unit 36 can calculate the correct current time.

The current time corrected by the time correcting unit 36 is output to the internal time calculating circuit 17 and the current time calculated by the internal time calculating circuit 17 is corrected. The corrected current time is also sent to the display unit 13 to be displayed thereon.

When it is determined at step 605 that the minimum number of errors E(p) is not valid (NO at step 605), the prognostic TCO data generating unit 33 samples two continuous frames of data at step 607, and sums up and averages bits corresponding to respective frames of data, thereby obtaining an average data at step 608.

In practice, the prognostic TCO data generating unit 33 has already sampled one frame of data at step 602. Therefore, the subsequent frame of data is sampled, and the sampled data of two frames is temporarily stored in RAM 14.

Further, the error calculating unit 34 performs a data comparing process to compare the input TCO data stored in the input TCO data memory 32 with the average data obtained by the prognostic TCO data generating unit 33 at step 630. The process at step 630 is substantially the same as the process at step 620 except that the average data is used in place of the prognostic TCO data at step 630.

At step 630, the error calculating unit 34 compares the input TCO data with the average data, that is, enters both data to EORs, and counts the total number of EORs which output 1, thereby obtaining the number of errors. The prognostic TCO data generating unit 33 successively shifts bits of the average data, thereby generating new average data. The error calculating unit 34 compares the input TCO data with the new average data to calculate the number of error at step 609.

The validity judging unit 35 detects the minimum number of errors E(p) at step 610 and judges whether the minimum number of errors E(p) is valid or not at step 611. When it is determined at step 611 that the minimum number of errors E(p) is valid (YES at step 611), the time correcting unit 36 calculates an error $\Delta t$ of the current time, based on the average data and input TCO data giving said minimum number of errors E(p), and corrects the current time using the error $\Delta t$ at step 606. The error $\Delta t$ is calculated in substantially the same manner as calculating the error $\Delta t$ using the prognostic TCO data.

In the present embodiment, one frame of data including time codes is sampled, whereby input TCO data is obtained. The bits of the input TCO data are successively compared with bits of the prognostic TCO data as the latter is successively shifted. When the number of errors indicating discrepaney between the bits of the both data is equivalent to a certain small value (the minimum value and/or local minimum value), a time difference is calculated between the current time calculated based on the number of shifting bits by the internal time calculating unit 17 and the current time indicated by the time codes included in the received standard time ratio wave. The current time calculated by internal time calculating unit 17 can be corrected using the calculated time difference without the second and minute synchronization processes so be performed on the signal including the time codes, wherein the signal is received by the receiving circuit 16.

In the embodiment, bits of one frame of input TCO data are compared with bits of one frame of prognostic TCO data, and it is judged whether or not the number of errors is valid. When it is determined that the number of errors is valid, the time difference between the current time calculated by the internal time calculating circuit 17 and the current time obtained from the time codes is calculated based on the number of shifting bits corresponding to the valid number of errors, wherein the prognostic TCO data is shifted by said number of shifting bits. As described above, the time difference can be calculated and the current time can be instantly corrected using the calculated the time difference.

Further, in the embodiment, when bits of one frame of input TCO data are compared with bits of one frame of the prognostic TCO data and the calculated number of errors is not valid, the an average value of bits of plural frames of prognostic TCO data is calculated and used, whereby enhancing S/N ratio. Then, bits of the prognostic TCO data are compared with bits of average data, whereby the valid number of errors can be easily calculated.

In the embodiment, the error calculating unit 34 compares bits of the input TCO data with bits of the prognostic TCO data to calculate the number of errors every time when the bits of the prognostic TCO data are shifted, and repeats the comparison of the bits and calculation of the number of errors until all the bits have been shifted. The validity judging unit 35 detects the minimum number of errors among the numbers of errors and judges whether the minimum number of errors is valid or not, whereby the time difference can be calculated based on the shifting position where the most appropriate number of errors is obtained.

For instance, it can be judged based on the calculated average value and the standard deviation of the numbers of errors, whether the minimum number of errors is valid or not, whereby a proper judgment can be made in accordance with the state of the S/N ratios.

In the embodiments, the bits of the prognostic TCO data are shifted to be compared with the input TCO data, and all the numbers of errors are calculated, and then it is judged whether the minimum number of errors among them is valid or not. But a modification may be made to the above embodiments such that the prognostic TCO data or average data is successively shifted, and the shifted prognostic TCO data or average data is compared with the input TCO data to successively calculate the numbers of errors, and then it is successively judged if the calculated number of errors is valid, and at the time when it has been determined that the calculated number of errors is valid, then data comparing process is not performed anymore and a time difference of the calculated current time from the standard time is calculated instantly.

Figure 7:
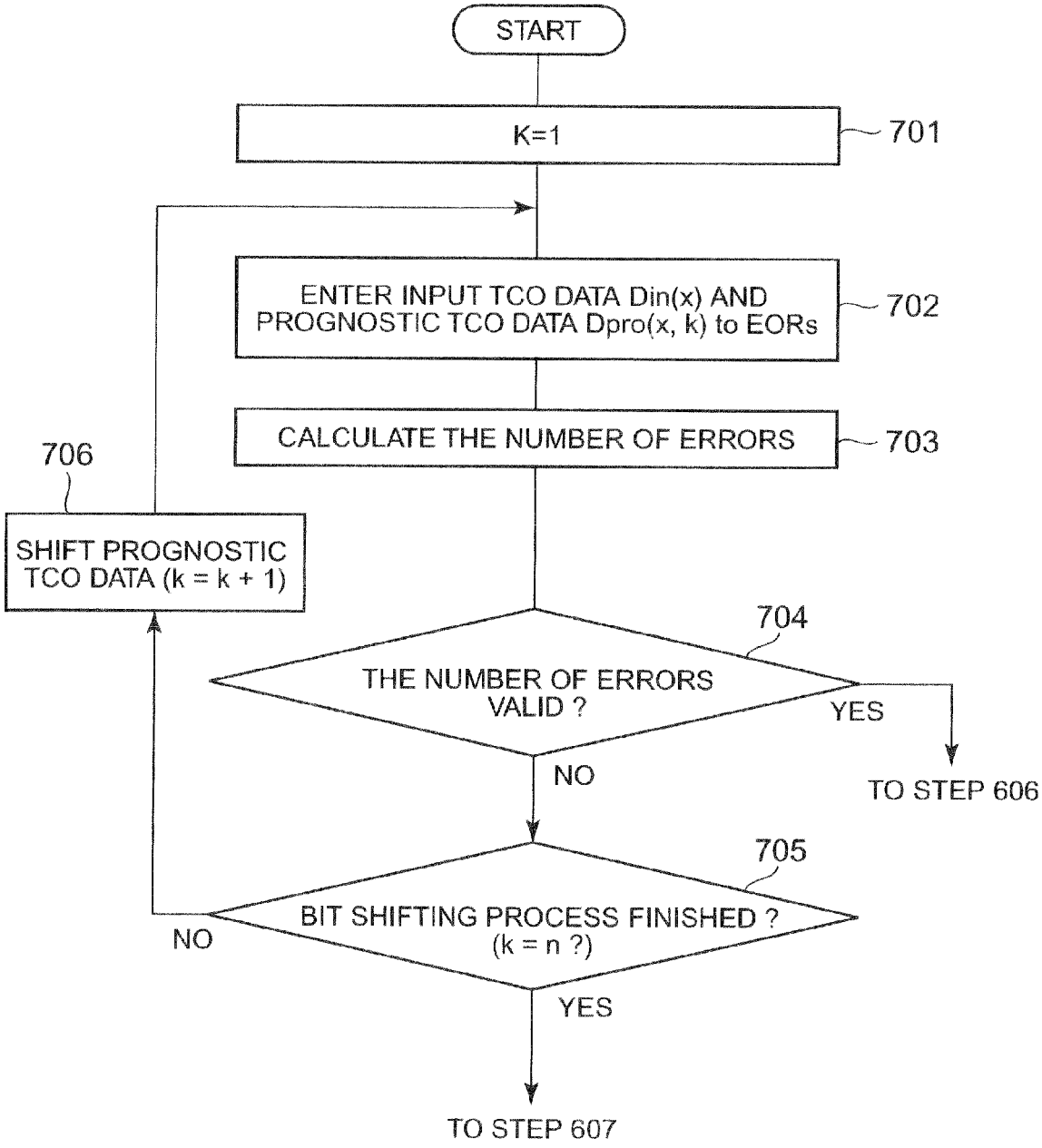
FIG. 7 is a flow chart of a data comparing process for comparing input TCO data with prognostic TCO data in the second embodiment of the invention.

FIG. 7 is a flow chart of a data comparing operation (step 620 in FIG. 6) for comparing input TCO data with prognostic TCO data in the second embodiment of the invention.

In the second embodiment, the error calculating unit 34 initializes a parameter "k" to "0", wherein the parameter "k" is for specifying the prognostic TCO data Dpro (x, k). The error calculating unit 34 enters bits of the input TCO data Din(x) and bits of the prognostic TCO data Dpro (x, k) to EORs to compare the input TCO data with the prognostic TCO data at step 702. Further, the error calculating unit 34 counts the number of EORs which output "1", thereby calculating the number of errors E(k) at step 703.

The validity nudging unit 35 judges at step 704 whether or not the calculated number of errors E(k) is valid. The judgment will be made as described below.

The numbers of errors are distributed such that local minimum values of errors appear every one second as shown in FIG. 5. Therefore, the prognostic TCO data is shifted at least by a step (1/T) corresponding to one second, and when the shifted prognostic TCO data and the input TCO data have been compared with each other, an average value and the standard deviation of the numbers of errors are calculated. If the local minimum number of errors is smaller than a value of "average value−standard deviation", it can be determined that the local minimum number of errors is valid. Alternately, using a certain threshold value instead of the statistical method, when the number of errors is smaller than the certain threshold value, then it may be determined that such number of errors is valid.

When it is determined at step 706 that the calculated number of errors E(x) is valid (YES at step 704), a process for correcting "seconds" (step 606 in FIG. 6) is performed. On the contrary, when it is determined at step 706 that the calculated number of errors E(x) is not valid (NO at step 704), it is judged at step 705 whether or not a bit shifting process has been finished with respect to all the bits, that is, whether "k"="n" becomes true or not. When it is determined at step 705 that "k"="n" is not true (NO at step 705), the prognostic TCO data is shifted by "k"="k+1" at step 706. Then, bits of the prognostic TCO data shifted as described above are compared with bits of the input TCO data at step 702.

When it is determined at step 705 that "k"="n" is true (YES at step 705), the operation advances to step 607 in FIG. 6, where average data is calculated, and the data comparing process is performed to compare the obtained average data with the input TCO data at step 630. The data comparing process at step 630 is substantially the same as the data comparing process shown in FIG. 7 except that the average data is used in place of the prognostic TCO data.

In the second embodiment, if it has been determined that the calculated number of errors is valid, while the prognostic TCO data is successively shifted to be compared with the input TCO data, then the time difference between the current time calculated by the internal time calculating circuit 17 and the standard current time is calculated instantly without further obtaining the numbers of errors with respect to all the shifted bits, whereby a processing time can be saved.

The scope of present invention is not restricted to the embodiments described above, but variations may be made within the scope defined by an accompanying claim description and such variations will be covered by the claim description.

In the embodiments, the bits of one frame of input TCO data are successively compared with the bits of the prognostic TCO data as the latter is successively shifted, and when the number of errors obtained in the data comparing process is not valid, an average of appropriate bits included in two frames of input TCO data is calculated to obtain average data, and bits of the average data are compared with the bits of the prognostic TCO data as the latter are successively shifted to calculate the number of errors, and it is judged whether the calculated number of errors is valid or not.

But a modification may be made to the embodiments. For instance, appropriate bits of plural frames of input TCO data are summed up and averaged, whereby average data is obtained. The obtained average data is compared with the prognostic TCO data which is successively shifted to calculate the number of errors, and it is judged whether the calculated number of errors is valid or not. In the above description, bits of two frames of data are summed up and averaged, but bits of three or more frames of data may be used to obtain average data of bits.

In the above embodiments, the bits of the prognostic TCO data are successively shifted, but instead of the bits of the prognostic TCO data, the bits of the input TCO data or average data thereof may be successively shifted to be compared with the bits of prognostic TCO data.

In the above description, bits of plural frames of input TCO data are summed up and averaged to obtain average data, and the average data is compared with the prognostic TCO data. But a modification may be made to the above embodiment such that appropriate bits of plural frames of input TCO data are summed up to obtain summed-up data, and the summed-up data is compared with multiplied prognostic TCO data, wherein the multiplied prognostic TCO data is obtained by multiplying the prognostic TCO data by such plural number.

What is claimed is:

1. A time correcting apparatus comprising:

a signal reception unit that receives a standard time radio wave;

an input TCO data generating unit that performs sampling of a signal including a time code output from the signal reception unit so as to temporarily store a bit string of a predetermined number of frames in a memory as input TCO data;

an internal time measurement unit that obtains a current time by an inner clock;

a prognostic TCO data generating unit that generates a bit string of prognostic TCO data corresponding to the current time based on the current time obtained by the internal time measurement unit;

an error number calculating unit that compares bits of the input TCO data with bits of the prognostic TCO data so as to calculate a number of errors corresponding to a number of discrepancies between the bits of the two pieces of TCO data, and repeats comparison of the bits by using new TCO data generated by shifting the bits of the prognostic TCO data or the input TCO data, thereby calculating a plurality of numbers of errors relating to the comparisons, respectively;

a validity judging unit that judges whether or not one of the numbers of errors calculated by the error number calculating unit is valid;

an error calculating unit that calculates an error of the current time obtained by the internal time measurement unit based on a number of shifted bits relating to the calculation of the number of errors judged to be valid; and a correction unit that corrects the current time of the inner time measurement unit based on the error calculated by the error calculation unit.

2. The time correcting apparatus according to claim 1, wherein the error number calculating unit compares bits of one frame of input TCO data with bits of one frame of prognostic TCO data.

3. The time correcting apparatus according to claim 1, wherein the error number calculating unit compares bits of averaged data obtained by summing and averaging bits corresponding to a plurality of frames of input TCO data with bits of one frame of prognostic TCO data.

4. The time correcting apparatus according to claim 1, wherein in a case in which the error number calculating unit compares bits of one frame of input TCO data with bits of one frame of prognostic TCO data so as to calculate the numbers of errors and the validity judging unit judges that the one of the numbers of errors is not valid, the error number calculating unit compares bits of averaged data obtained by summing and averaging bits corresponding to a plurality of frames of input TCO data with bits of one frame of prognostic TCO data so as to calculate the numbers of errors and the validity judging unit judges the validity of one of the numbers of errors.

5. The time correcting apparatus according to claim 1, wherein the error number calculating unit compares bits of the input TCO data with bits of the prognostic TCO data so as to calculate the numbers of errors until all of the bits of the prognostic TCO data or the input TCO data have been shifted, and the validity judging unit detects a local minimum value of the numbers of errors so as to judge the validity of the local minimum value.

6. The time correcting apparatus according to claim 2, wherein the error number calculating unit compares bits of the input TCO data with bits of the prognostic TCO data so as to calculate the numbers of errors until all of the bits of the prognostic TCO data or the input TCO data have been shifted, and the validity judging unit detects a local minimum value of the numbers of errors so as to judge the validity of the local minimum value.

7. The time correcting apparatus according to claim 3, wherein the error number calculating unit compares bits of the input TCO data with bits of the prognostic TCO data so as to calculate the numbers of errors until all of the bits of the prognostic TCO data or the input TCO data have been shifted, and the validity judging unit detects a local minimum value of the numbers of errors so as to judge the validity of the local minimum value.

8. The time correcting apparatus according to claim 4, wherein the error number calculating unit compares bits of the input TCO data with bits of the prognostic TCO data so as to calculate the numbers of errors until all of the bits of the prognostic TCO data or the input TCO data have been shifted, and the validity judging unit detects a local minimum value of the numbers of errors so as to judge the validity of the local minimum value.

9. The time correcting apparatus according to claim 1, wherein in a case in which the number of shifted bits in the bits of the prognostic TCO data or the input TCO data exceeds a number of shifted bits corresponding at least to one second, the validity judging unit detects a local minimum value of the calculated numbers of errors and judges the validity of the local minimum value.

10. The time correcting apparatus according to claim 2, wherein in a case in which the number of shifted bits in the bits of the prognostic TCO data or the input TCO data exceeds a number of shifted bits corresponding at least to one second, the validity judging unit detects a local minimum value of the calculated numbers of errors and judges the validity of the local minimum value.

11. The time correcting apparatus according to claim 3, wherein in a case in which the number of shifted bits in the bits of the prognostic TCO data or the input TCO data exceeds a number of shifted bits corresponding at least to one second, the validity judging unit detects a local minimum value of the calculated numbers of errors and judges the validity of the local minimum value.

12. The time correcting apparatus according to claim 5, wherein the judgment of the validity is made based on an average value and a standard deviation of the calculated numbers of errors.

13. The time correcting apparatus according to claim 6, wherein the judgment of the validity is made based on an average value and a standard deviation of the calculated numbers of errors.

14. The time correcting apparatus according to claim 7, wherein the judgment of the validity is made based on an average value and a standard deviation of the calculated numbers of errors.

15. The time correcting apparatus according to claim 8, wherein the judgment of the validity is made based on an average value and a standard deviation of the calculated numbers of errors.

16. The time correcting apparatus according to claim 9, wherein the judgment of the validity is made based on an average value and a standard deviation of the calculated numbers of errors.

17. The time correcting apparatus according to claim 10, wherein the judgment of the validity is made based on an average value and a standard deviation of the calculated numbers of errors.

18. The time correcting apparatus according to claim 11, wherein the judgment of the validity is made based on an average value and a standard deviation of the calculated numbers of errors.

19. A radio controlled timepiece comprising:

the time correcting apparatus according to claim 1; and a time display unit that displays an obtained current time.

* * * * *